US008282430B2

(12) United States Patent
He et al.

(10) Patent No.: US 8,282,430 B2
(45) Date of Patent: Oct. 9, 2012

(54) ELECTRICAL CONTACT

(75) Inventors: Hang-Xiao He, Guang-Dong (CN); Wei-Hong Liao, Guang-Dong (CN); Ming-Chiang Chen, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 485 days.

(21) Appl. No.: 12/699,810

(22) Filed: Feb. 3, 2010

(65) Prior Publication Data

US 2011/0186331 A1 Aug. 4, 2011

(51) Int. Cl.
*H01R 4/48* (2006.01)

(52) U.S. Cl. ..... 439/862

(58) Field of Classification Search ..... 439/862, 439/816, 78, 68, 786, 736, 71, 851, 836, 439/668, 834, 835, 885; 174/126.1
See application file for complete search history.

(56) References Cited

U.S. PATENT DOCUMENTS

| | | | | | |
|---|---|---|---|---|---|
| 4,907,990 | A * | 3/1990 | Bertho et al. | 439/851 |
| 5,092,783 | A * | 3/1992 | Suarez et al. | 439/71 |
| 5,213,513 | A * | 5/1993 | Brown et al. | 439/68 |
| 5,984,738 | A * | 11/1999 | Michelmann et al. | 439/786 |
| 6,027,381 | A * | 2/2000 | Lok | 439/736 |
| 6,551,149 | B2 * | 4/2003 | Orihara | 439/862 |
| 6,676,456 | B1 * | 1/2004 | Horng | 439/862 |
| 7,131,875 | B2 * | 11/2006 | Kodaira et al. | 439/862 |
| D569,801 | S * | 5/2008 | Chuang | D13/133 |
| 7,497,715 | B2 * | 3/2009 | Wu | 439/329 |
| D608,295 | S * | 1/2010 | Huang | D13/154 |
| D614,583 | S * | 4/2010 | Wang | D13/154 |
| 7,927,158 | B2 * | 4/2011 | Kim et al. | 439/816 |
| D644,186 | S * | 8/2011 | Qu et al. | D13/154 |
| 8,070,498 | B2 * | 12/2011 | Shen | 439/66 |
| D660,249 | S * | 5/2012 | Chen et al. | D13/154 |
| 8,206,188 | B1 * | 6/2012 | Zhang et al. | 439/862 |
| 2006/0105640 | A1 * | 5/2006 | Vance | 439/862 |
| 2011/0177718 | A1 * | 7/2011 | Shen | 439/625 |
| 2011/0186331 | A1 * | 8/2011 | He et al. | 174/126.1 |

* cited by examiner

*Primary Examiner* — Alexander Gilman
(74) *Attorney, Agent, or Firm* — Cheng-Ju Chiang

(57) ABSTRACT

An electrical contact includes a soldering plate, first curved plate extended upwardly from one end of the soldering plate, a middle plate extended from the free end of the curved plate, a second curved plate extended upwardly from the free end of the soldering plate, a contact plate extended from the free end of the second curved plate, a vertical plate extended downwardly from each of opposite lateral edges of the contact plate and beyond a bottom surface of the middle plate, and a restricting plate extended inwardly from the vertical plate and positioned between the soldering plate and the middle plate. The movement of the contact plate and the middle plate are limited to resist a vertical force for preventing the electrical contact from permanent deformation in a vertical direction by the restricting plates.

7 Claims, 2 Drawing Sheets

ELECTRICAL CONTACT

BACKGROUND OF THE INVENTION

1. Field of the Invention

The present invention relates to an electrical contact, more specifically, to an electrical contact capable of resisting a vertical force.

2. The Related Art

Please refer to FIG. 3. A conventional electrical contact 100' is pressed from a metallic foil and mounted to a printed circuit board by SMT (Surface Mounted Technology). Hence, the electrical contact is provided with elasticity and functions as a buffer for interconnecting an element and the printed circuit board.

The electrical contact 100' has a soldering plate 10', an elastic portion 20' and a contact plate 30'. The soldering plate 10' is mounted and soldered to the printed circuit board. The elastic portion 20' is extended from one end of the soldering plate 10' and includes a first curved plate 21', a middle plate 22' and a second curved plate 23'.

The first curved plate 21' is upwardly extended from one end of the soldering plate 10'. The middle plate 22' horizontally extended from the free end of the first curved plate 21'. The second curved plate 23' is upwardly extended from the free end of the middle plate 22'. The contact plate 30' is extended from the free end of the second curved plate 23'.

Especially, the soldering plate 10', the middle plate 22' and the contact plate 30' are aligned to each other in a vertical direction. That is, the soldering plate 10', the middle plate 22' and the contact plate 30' are overlapped in the vertical direction. Each of opposite lateral edges of contact plate 30' is downwardly extended a vertical plate 31'. Hence, the vertical plate 31' can resist a lateral force for preventing the contact plate 30' from being laterally deformed However, if the electrical contact 100' is urged to be over extended by a vertical force, such as pulling the soldering plate 10' and the contact plate 30', the middle plate 22' will be apt to become permanent deformation in a vertical direction according to the elasticity deformation thereof.

SUMMARY OF THE INVENTION

An object of the present invention is to provide an electrical contact capable of resisting a vertical force.

According to the invention, the electrical contact includes a soldering plate, first curved plate extended upwardly from one end of the soldering plate, a middle plate extended from the free end of the curved plate, a second curved plate extended upwardly from the free end of the soldering plate, a contact plate extended from the free end of the second curved plate, a vertical plate extended downwardly from each of opposite lateral edges of the contact plate and beyond a bottom surface of the middle plate, and a restricting plate extended inwardly from the vertical plate and positioned between the soldering plate and the middle plate.

If the middle plate is urged to move downwardly by a pulling force in a vertical direction, the middle plate will be pulled downwardly to abut against the restricting plates. Hence, the restricting plates can restrict the movement of the middle plate for preventing the middle plate from permanent deformation in the vertical direction.

If the contact plate is urged to be move upwardly by a pulling force in the vertical direction, the restricting plates will be pulled upwardly with the contact plate to abut against the bottom surface of the middle plate. Hence, the restricting plates can restrict the movement of the contact plate for preventing the contact plate from permanent deformation in the vertical direction.

Therefore, the movement of the contact plate and the middle plate are limited to resist the vertical force for preventing the electrical contact from permanent deformation in the vertical direction by the restricting plates.

BRIEF DESCRIPTION OF THE DRAWINGS

The present invention will be apparent to those skilled in the art by reading the following description of preferred embodiments thereof, with reference to the attached drawings, in which.

DETAILED DESCRIPTION OF THE PREFERRED EMBODIMENT

Figure 1:
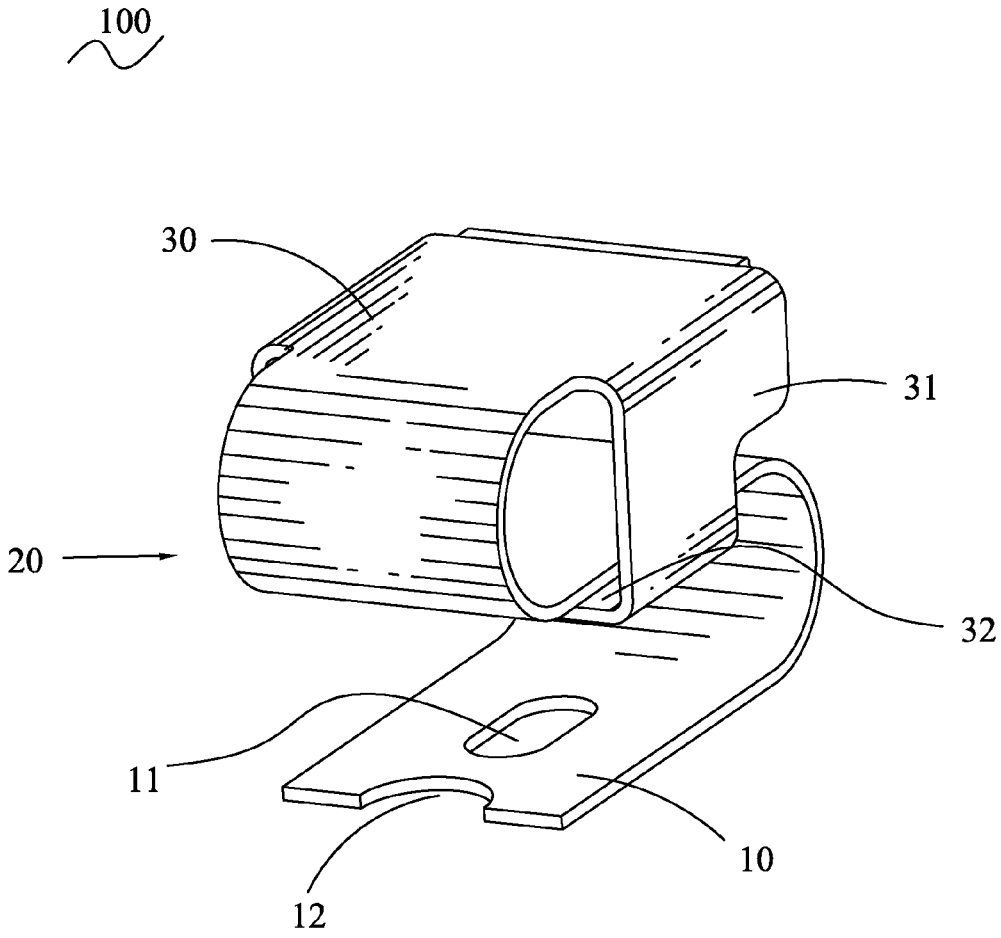
FIG. 1 is a perspective view of an electrical contact according to the present invention.
Figure 2:
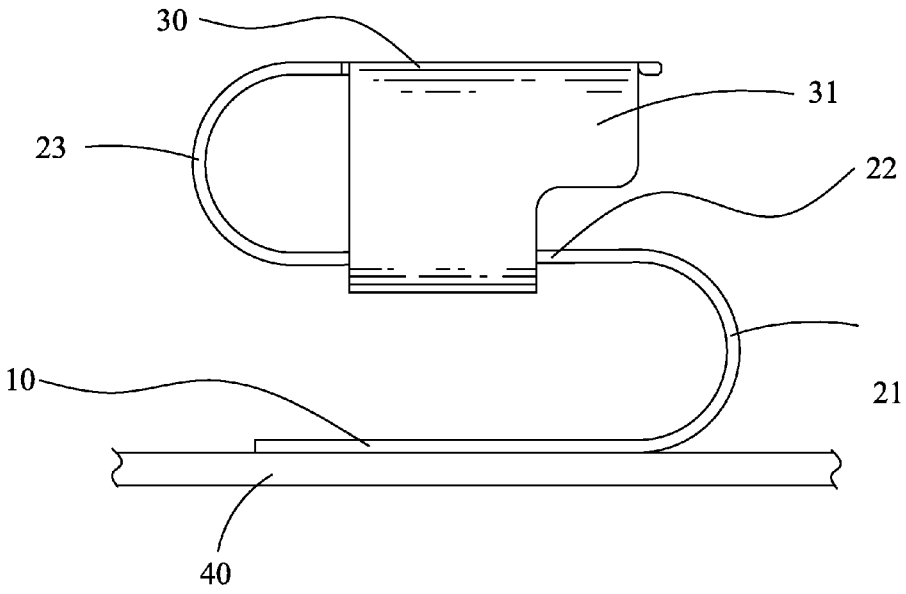
FIG. 2 shows the electrical contact shown in FIG. 1 mounted to a printed circuit board.
Figure 3:
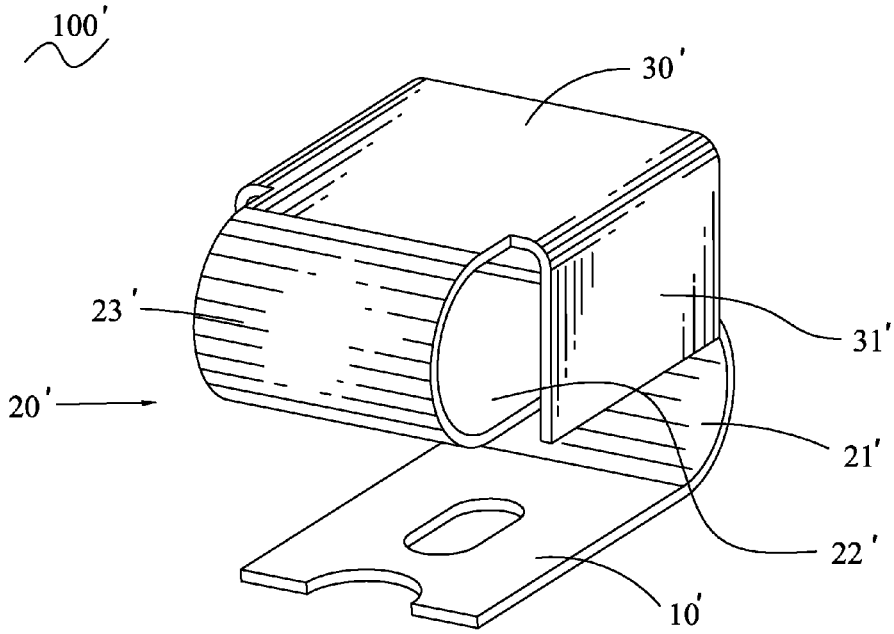
FIG. 3 (PRIOR ART)
FIG. 3 is a perspective view of a conventional electrical contact.

Please refer to FIG. 1 and FIG. 2. FIG. 1 is a perspective view of an electrical contact according to the present invention. FIG. 2 is a lateral view showing the electrical contact mounted to a printed circuit board. The electrical contact 100 is pressed from a metallic foil and mounted to a printed circuit board 40 by SMT (Surface Mounted Technology). Hence, the electrical contact 100 is provided with elasticity and functions as a buffer for interconnecting an element (not shown in figures) and the printed circuit board 40.

The electrical contact 100 includes a soldering plate 10, an elastic portion 20 and a contact plate 30. The soldering plate 10 is of rectangular shape and mounted to and soldered to the printed circuit board 40. The soldering plate 10 defines a through hole 11 positioned in a central portion and a cutout 12 formed in one end thereof. The through hole 11 and the cutout can assist the soldering plate 10 for being firmly soldered to the printed circuit board 40.

The elastic portion 20 is substantially a S-shaped. The elastic portion 20 is extended between the soldering plate 10 and the contact plate 30. The elastic portion 20 includes a first curved plate 21, a middle plate 22 and a second curved plate 23.

The first curved plate 21 is upwardly extended from the other end of the soldering plate 10. The middle plate 22 is horizontally extended from the free end of the first curved plate 21. The second curved plate 23 is upwardly extended from the free end of the middle plate 22. The first curved plate 21 and the second curved plate 23 are substantially U-shape and transversely faced to each other. Each of the openings of the first curved plate 21 and the second curved plate 23 is faced inwardly.

The contact plate 30 is horizontally extended from the free end of the second curved plate 23. The soldering plate 10, the middle plate 22 and the contact plate 30 are aligned and parallel to each other in a vertical direction. That is the soldering plate 10', the middle plate 22' and the contact plate 30' are overlapped in the vertical direction.

Hence, the contact plate 30 can be moved in the vertical direction and returned to original via the elasticity of the first curved plate 21 and the second curved plate 23 of the elastic portion 20. The electrical contact 100 functions as a buffer.

Each of opposite lateral edges of contact plate 30 is downwardly extended a vertical plate 31. The vertical plate 31 extends downwardly to beyond a bottom surface of the middle plate 22. Hence, the vertical plates 31 can resist a lateral force for preventing the contact plate 30 from permanent deformation in the lateral direction.

Each of bottom edges of the vertical plate 31 is inwardly extended a restricting plate 32. The restricting plates 32 are adjacent to and parallel with the middle plate 22. If the middle plate 22 is urged to be move downwardly by a pulling force in the vertical direction, the middle plate 22 will be pulled downwardly to abut against the restricting plates 32. Hence, the restricting plates 32 can restrict the movement of the middle plate 22 for preventing the middle plate 22 from permanent deformation in the vertical direction.

If the contact plate 30 is urged to be move upwardly by a pulling force in the vertical direction, the restricting plates 32 are pulled upwardly with the contact plate 30 to abut against the bottom surface of the middle plate 22. Hence, the restricting plates 32 can restrict the movement of the contact plate 30 for preventing the contact plate 30 from permanent deformation in the vertical direction.

As described above, according to the restricting plates 32 of the electrical contact 100, the movement of the contact plate 30 and the middle plate 22 are limited to resist the vertical force for preventing the electrical contact 100 from permanent deformation in the vertical direction.

Furthermore, the present invention is not limited to the embodiments described above; diverse additions, alterations and the like may be made within the scope of the present invention by a person skilled in the art. For example, respective embodiments may be appropriately combined.

What is claimed is:

1. An electrical contact, comprising:

a soldering plate;

a first curved plate extended upwardly from one end of the soldering plate;

a middle plate extended from the free end of the curved plate;

a second curved plate extended upwardly from the free end of the soldering plate;

a contact plate extended from the free end of the second curved plate;

a vertical plate extended downwardly from each of opposite lateral edges of the contact plate and beyond a bottom surface of the middle plate; and a restricting plate extended inwardly from the vertical plate and positioned between the soldering plate and the middle plate.

2. The electrical contact as claimed in claim 1, wherein the soldering plate, the middle plate and the contact plate are aligned to each other in a vertical direction.

3. The electrical contact as claimed in claim 2, wherein the soldering plate, the middle plate and the contact plate are overlapped in a vertical direction.

4. The electrical contact as claimed in claim 3, wherein the soldering plate, the middle plate and the contact plate are horizontal.

5. The electrical contact as claimed in claim 4, wherein each of the first curved plate and the second curved plate is of transverse U-shaped, each of openings of the first curved plate and the second curved plate is faced inwardly.

6. The electrical contact as claimed in claim 5, wherein the soldering plate is formed a through hole in a central portion thereof.

7. The electrical contact as claimed in claim 6, wherein the soldering plate is formed a cutout in an edge thereof.

* * * * *